US011559998B2

(12) United States Patent
Urrutia Nebreda et al.

(10) Patent No.: US 11,559,998 B2
(45) Date of Patent: Jan. 24, 2023

(54) RETRACTABLE PRINTABLE MEDIUM SUPPORT

(71) Applicant: Hewlett-Packard Development Company, L.P., Spring, TX (US)

(72) Inventors: Martin Urrutia Nebreda, Sant Cugat del Valles (ES); Joseba Ormaechea Saracibar, Sant Cugat del Valles (ES); Javier Garcia Blanco, Sant Cugat del Valles (ES); Angel Gistas Perez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 187 days.

(21) Appl. No.: 16/959,257

(22) PCT Filed: Jan. 31, 2018

(86) PCT No.: PCT/US2018/016191

§ 371 (c)(1),
(2) Date: Jun. 30, 2020

(87) PCT Pub. No.: WO2019/152012

PCT Pub. Date: Aug. 8, 2019

(65) Prior Publication Data

US 2020/0331278 A1 Oct. 22, 2020

(51) Int. Cl.
*B41J 11/00* (2006.01)
*B41J 11/68* (2006.01)
(Continued)

(52) U.S. Cl.
CPC ..... *B41J 11/0045* (2013.01); *B41J 11/14* (2013.01); *B41J 11/20* (2013.01); *B41J 11/68* (2013.01); *B41J 11/70* (2013.01); *B41J 11/706* (2013.01); *B65H 5/36* (2013.01); *B41J 11/02* (2013.01); *B41J 11/06* (2013.01); *B41J 11/08* (2013.01);
(Continued)

(58) Field of Classification Search
CPC ..... B41J 11/0045; B41J 11/14; B41J 11/20; B41J 11/68; B41J 11/70; B41J 11/706; B41J 11/02; B41J 11/06; B41J 11/08; B41J 11/10; B41J 11/16; B41J 11/18;
(Continued)

(56) References Cited

U.S. PATENT DOCUMENTS 4,512,505 A 4/1985 Westly
6,652,173 B1 * 11/2003 Martini ..... B41J 11/703 400/621
(Continued)

FOREIGN PATENT DOCUMENTS

JP 2003118187 4/2003
JP 4244960 12/2006
(Continued)

*Primary Examiner* — Henok D Legesse

(57) ABSTRACT

A printable medium support for a printer comprises a support element to support a printable medium, wherein the support element is movable between a protruding configuration to support the printable medium, and a retracted configuration in which the support element is at least partially retracted in a first direction. The printable medium support comprises an actuating element to move the support element between the protruding configuration and the retracted configuration.

15 Claims, 7 Drawing Sheets

(51) Int. Cl.

| | |
|---|---|
| ***B41J 11/70*** | (2006.01) |
| ***B65H 5/36*** | (2006.01) |
| ***B41J 11/20*** | (2006.01) |
| ***B41J 11/14*** | (2006.01) |
| *B41J 11/66* | (2006.01) |
| *B41J 11/06* | (2006.01) |
| *B41J 11/08* | (2006.01) |
| *B41J 11/18* | (2006.01) |
| *B41J 11/16* | (2006.01) |
| *B41J 11/10* | (2006.01) |
| *B41J 11/02* | (2006.01) |

(52) U.S. Cl.
CPC ..... *B41J 11/10* (2013.01); *B41J 11/16* (2013.01); *B41J 11/18* (2013.01); *B41J 11/66* (2013.01); *B41J 11/663* (2013.01); *B41J 11/703* (2013.01); *B65H 2404/511* (2013.01); *B65H 2404/513* (2013.01)

(58) Field of Classification Search
CPC ..... B41J 11/66; B41J 11/663; B41J 11/703; B65H 5/36; B65H 2404/511; B65H 2404/513
See application file for complete search history.

(56) References Cited

U.S. PATENT DOCUMENTS

| | | | | |
|---|---|---|---|---|
| 8,506,071 | B2 | 8/2013 | Sato | |
| 2004/0184863 | A1 | 9/2004 | Mori | |
| 2006/0039738 | A1* | 2/2006 | Murata | B65H 35/06 400/615.2 |
| 2008/0238996 | A1 | 10/2008 | Takada | |
| 2008/0298872 | A1* | 12/2008 | Kubota | B41J 3/4075 400/621 |
| 2020/0331281 | A1* | 10/2020 | Gistas Perez | B41J 11/70 |

FOREIGN PATENT DOCUMENTS

| | | |
|---|---|---|
| JP | 5136753 | 4/2009 |
| JP | 2009269319 | 11/2009 |
| JP | 5700205 | 8/2012 |
| JP | 2013158894 | 8/2013 |

* cited by examiner

RETRACTABLE PRINTABLE MEDIUM SUPPORT

BACKGROUND

In a printer, a printable medium is supported by support structures to guide the printable medium in the printer. The guidance provided by the support structures should be mostly continuous to define a path of the printable medium through the printer.

BRIEF DESCRIPTION OF THE DRAWINGS

The following detailed description will best be understood with reference to the drawings, wherein.

DETAILED DESCRIPTION

To provide continuous guidance for a printable medium the printable medium support structures of the printer may be located in close proximity to each other, such as to prevent the printable medium from deviating from its intended path along a feeding direction. However, when the support structures are closely spaced, the available space for rearranging printer elements may be limited. For example, a rearranging of printer elements may occur during a modification of the printable area of the printer.

To allow for the movement of printer elements while still providing guidance for the printable medium, a support element of the printable medium support structure can be retractable.

More specifically, by providing a retractable support element with an engageable element which can be engaged by movable elements of the printer, the support element may be automatically retracted when the movable printer elements are close to the support element, such that the movable printer element, such as a cutter to cut the printable medium, may pass the printable medium support largely unobstructed.

Figure 1:
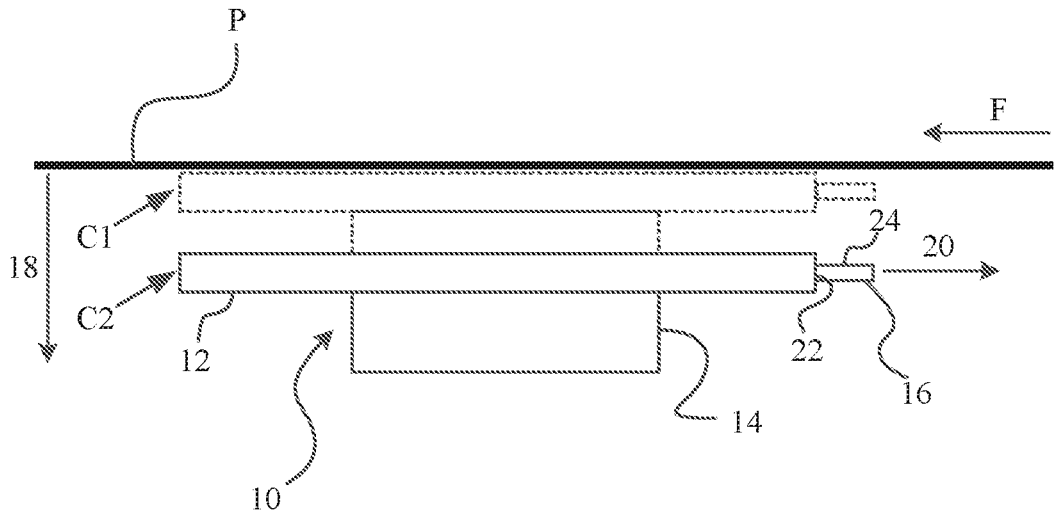
FIG. 1 illustrates a side view of a printable medium support according to an example.

An example of a printable medium support 10 for a printable medium P is shown in FIG. 1 and comprises a support element 12, an actuating element 14 that may be, e.g., an elastic element 14 and may also comprise a protruding portion 16 protruding from the support element 12.

The printable medium P supported by the printable medium support 10 may be supplied along a feeding direction F and may be any medium on which a printing fluid can be applied. In the following, the functionality of printers, printable medium supports 10 or methods according to examples will be described with respect to the printable medium P made of paper; however, any printable medium P may be used. For example, the printable medium P may be paper and/or paper-based, such as cardboard, and/or textiles and/or leather and/or polymers and/or combinations thereof, etc.

The printing fluid may be any appropriate material suitable to print a graphical or shaped element onto the printable medium P, such as a printing fluid or a build material. The graphical or shaped element may be a text, an image, lines, shapes, letters, numerals, signs, symbols or a combination of these in an arbitrary color, alignment or shape.

The support element 12 can support the printable medium P and is movable between a protruding configuration C1 to support the printable medium P and a retracted configuration C2, in which the support element 12 is at least partially retracted in a first direction 18.

Supporting the printable medium P is considered to refer to supporting at least a portion of the printable medium P against a weight of the printable medium P and thereby guide and/or position the printable medium P in the printer by the support element 12.

In FIG. 1, the first direction 18 in which the support element 12 is retracted, when the support element 12 is moved between the protruding configuration C1 and the retracted configuration C2, is shown to be perpendicular to the feeding direction F. In some examples, an angle between the first direction 18 and the feeding direction F is between 60° and 120°. However, the first direction 18 may be any direction and may, for example, also be parallel to the feeding direction F. In some examples, the first direction 18 comprises a directional component oriented along the direction of the weight force of the printable medium P.

The actuating element 14 can move the support element 12 between the protruding configuration C1 and the retracted configuration C2 or bias the support element 12 towards the protruding configuration C1.

In some examples, the actuating element 14 comprises an electromagnet or a permanent magnet, such as a solenoid or a material with magnetic remanence, a pneumatic or hydraulic actuator, or other actuating elements 14 to passively or actively move the support element 12 between the protruding configuration C1 and the retracted configuration C2 or to keep the support element 12 in the protruding configuration C1, when the support element 12 supports the printable medium P.

In some examples, the actuating element 14 comprises an elastic element 14. For the sake of brevity, the function and structure of examples of printable medium supports 10 and printers will be explained with the actuating element 14 comprising an elastic element 14 in the following. However, in principle any actuating element 14 may be used and can replace or implement the functions of the elastic element 14 described in the examples of printable medium supports 10 and printers below.

The elastic element 14 may bias the support element 12 towards the protruding configuration C1 and may keep the support element 12 in the protruding configuration C1, when the support element 12 supports the printable medium P.

In other words, the weight of a single layer of the printable medium P may not be sufficient to move the support element 12 towards the retracted configuration C2 against the restoring force of the elastic element 14. For example, the spring constant of the elastic element 14 may be chosen to provide a restoring force greater than 0.1 N or greater than 1 N, in the protruding configuration C1 to prevent the support element 12 from moving into the retracted configuration C2, when the support element 12 supports the printable medium P.

The elastic element 14 may be connected to the support element 12 or may be an integral part of the support element 12. For example, the elastic element 14 may be a deformable medium, which is deformed to move the support element 12 between the protruding configuration C1 and the retracted configuration C2 and provides a restoring force to move the support element 12 towards the protruding configuration C1. In some examples, the elastic element 14 comprises a spring.

The protruding and retracted configurations C1, C2 may correspond to different spatial positions of the support element 12 or to different spatial arrangements of the support element 12, such as a translated and/or deformed and/or bent and/or rotated configuration of the support element 12.

In some examples, the elastic element 14 for biasing the support element 12 towards the protruding configuration C1 is different and/or distinct from the support element 12. Thus, the support element 12 may comprise at least one rigid portion to support the printable medium P and may for example comprise a portion made of a moldable plastic or a metal.

As shown in FIG. 1, the protruding portion 16 protrudes from the support element 12 in a second direction 20. The protruding portion 16 can be engageable to move the support element 12 into the retracted configuration C2. In some examples, the protruding portion 16 does not support the printable medium P in the protruding configuration C1 of the support element 12.

By engaging the protruding portion 16, a retracting force may be applied to the support element 12. When the retracting force overcomes the elastic force, i.e. the bias, of the elastic element 14, the support element 12 may be moved into the retracted configuration C2.

In some examples, the protruding portion 16 comprises a frustum or a cylinder, wherein a normal of the base 22 of the cylinder or the frustum extends in the second direction 20.

A frustum or a cylinder as described herein is considered to be a mathematical frustum or cylinder whose base may be arbitrarily chosen from arbitrary shapes and may not be limited to a circular shape. Furthermore, the frustum or cylinder may be at least partially hollow and may also comprise indentations or curved edges without deviating from the shape of the frustum or cylinder. However, in some examples, the base of the frustum or cylinder has an elliptical shape, such as a circular shape.

To move the support element 12 into the retracted configuration C2, the protruding portion 16 may be engaged at a side surface 24 of the protruding portion 16, the normal of the side surface 24 being different from the second direction 20. To reduce the friction between the protruding portion 16 and an engaging element (not shown) the side surface 24 may be curved to thereby reduce the surface area involved in engaging the protruding portion 16. In some examples, the protruding portion 16 may be rotatable to reduce a friction between the protruding portion 16 and a movable element of the printer.

As shown in FIG. 1, the second direction 20 may be different from the first direction 18. For example, the first and second direction 18, 20 may form an angle greater than 30°, or greater than 60°, or between 70° and 110°, such as a right angle (approximately 90°).

Figure 2A:
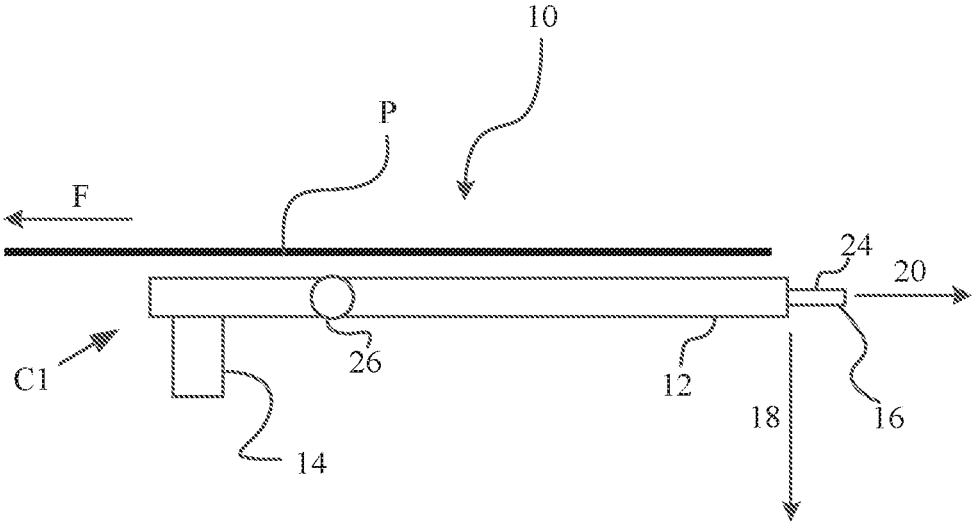
FIG. 2A illustrates a side view of a printable medium support according to a further example.
Figure 2B:
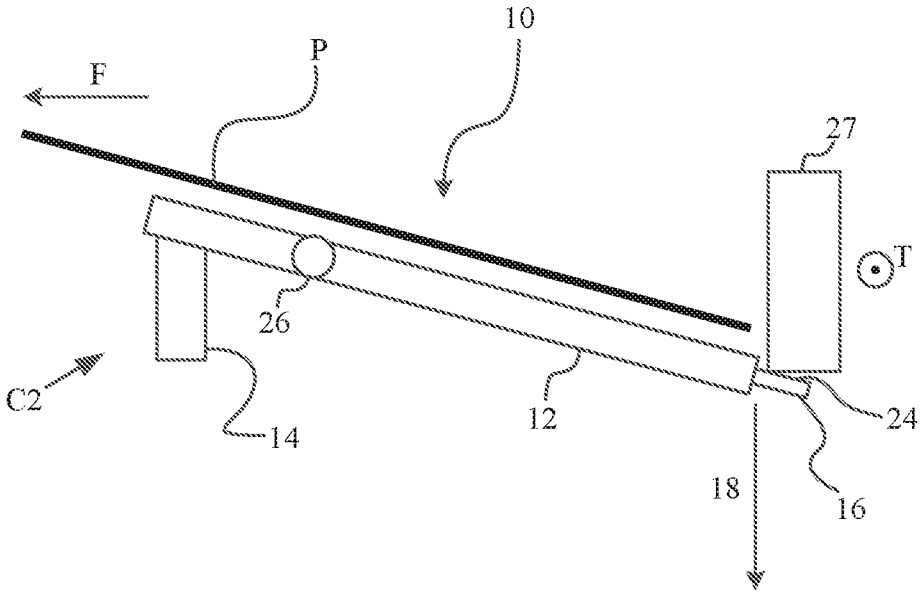
FIG. 2B illustrates the printable medium support depicted in FIG. 2A while engaged by a movable printer element according to an example.

FIGS. 2A and 2B show a further example of a printable medium support 10 in the protruding position C1 and the retracted position C2, respectively.

The printable medium support 10 comprises a support element 12, which is rotatable about an axis of rotation 26 and which is connected to an elastic element 14 to bias the support element 12 towards the protruding position C1 (depicted in FIG. 2A). The support element 12 comprises a protruding portion 16 which protrudes in a second direction 20 and is engageable to move the support element 12 into the retracted position C2.

In FIG. 2B, a movable printer element 27 engages the protruding portion 16 of the support element 12 and moves the support element 12 into the retracted position C2 by rotating the support element 12 about the axis of rotation 26 against the elastic force of the elastic element 14.

In the rotated position of the retracted configuration C2, the support element 12 does not obstruct the movement of the movable printer element 27 in a displacement direction T, which is normal to the section plane of the side view depicted in FIGS. 2A and 2B. Hence, the movable printer element 27 may pass along a side surface of the support element 12 unobstructed by engaging the protruding portion 16 during the movement of the movable printer element 27 and thereby actuating the support element 12.

Figure 3:
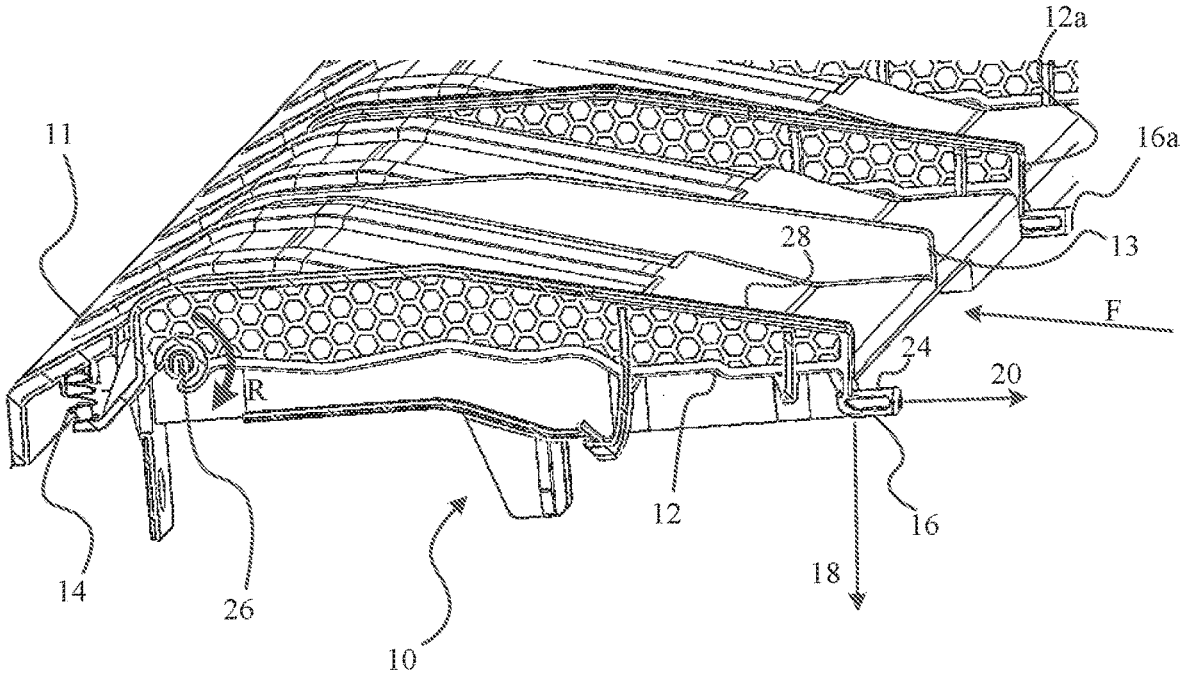
FIG. 3 illustrates a perspective view of a printable medium support according to a further example.

A further example of a printable medium support 10 is shown in FIG. 3. The printable medium support 10 comprises a support element 12 and an adjacent support element 12*a* which are connected to a support structure 11 and are rotatable about a rotation axis 26.

An elastic element 14 biases the support element 12 towards the protruding configuration C1 to support a printable medium P and to counteract a rotation R of the support element 12. As shown in FIG. 3, the elastic element 14 may comprise a spring to provide a restoring force towards the protruding configuration C1. The bias of the elastic element 14 may depend on the geometry of the support element 12 with respect to the axis of rotation 26. For example, in FIG. 3, the restoring force of the spring may be 5 N such as to provide a restoring force at the position of the protruding portion 16 of the support element 12 of 0.6 N.

The support element 12 may abut on a limiting portion 11*a* of the support structure 11 to define the protruding configuration C1 and provide guidance for the printable medium P. In other words, the protruding configuration C1 may be defined by the support element 12 abutting on the limiting portion 11*a* of the support structure 11.

The support elements 12, 12*a* of FIG. 3 have elongated structures, which are elongated in the feeding direction F and are spaced apart in a direction perpendicular to the feeding direction F. The support elements 12, 12*a* may then support the printable medium P supplied along the feeding direction F on an upper rib portion 28 of the support element 12 configured as a retractable support rib to limit a friction between the support elements 12, 12*a* and the printable medium P fed along the feeding direction F.

In some examples, the support element 12 comprises a support rib, the longest side of the support rib extending at least partially in a feeding direction F of the printable medium P to support the printable medium P on the upper rib portion 28. When the support rib is in the protruding configuration C1, the support rib may protrude from the printable medium support 10 or support structure 11 in the first direction 18.

As shown in FIG. 3, the printable medium support 10 may additionally comprise fixed ribs 13 to support the printable medium P.

The ribs and/or support elements 12, 12*a*, 13 may be spaced apart by a distance between 5 cm and 20 cm, such as 15 cm, to reduce the friction between the ribs 12, 12*a*, 13 and a printable medium P while still providing support for a printable medium P having a common page size, such as letter or A4 page size.

To move the support elements 12, 12*a* between the protruding configuration C1 (as shown in FIG. 3), the support elements 12, 12*a* comprise protruding portions 16, 16*a*, which are protruding from the printable medium support 10 in the second direction 20. By engaging the side surface 24 of the protruding portion 16, the elastic force of the elastic element 14 may be overcome and the support element 12 may be rotated about the axis of rotation 26 according to the rotation R, such that the support element 12 may be partially retracted into the printable medium support 10 (i.e. the support structure 11) along the first direction 18. Hence, the support element 12 changes between the protruding configuration C1 and the retracted configuration C2, when the support element 12 is rotated about the axis of rotation 26.

The adjacent support element 12*a* may be an identical support element and may also be rotatable about the rotation axis 26 by engaging a protruding portion 16*a* to move the adjacent support element 12*a* into a retracted configuration C2.

In some examples, the support element 12 is independently movable with respect to the adjacent support element 12*a*. In other words, engaging the protruding portion 16 of the support element 12 to move the support element 12 into the retracted configuration C2 may not move the adjacent support element 12*a* into the retracted configuration C2. Likewise, engaging the protruding portion 16*a* of the adjacent support element 12*a* to move the support element 12 into the retracted configuration C2 may not move the support element 12 into the retracted configuration C2.

Accordingly, in some examples the printable medium support 10 comprises at least two supports elements 12, 12*a* or support ribs 12, 12*a* to support a printable medium P, wherein the support elements 12, 12*a* or support ribs 12, 12*a* cooperate to support the printable medium P and are independently movable between respective protruding and retracted configurations C1, C2 by individually engaging protruding portions 16, 16*a* of the respective support elements 12, 12*a* or support ribs 12, 12*a* with a movable printer element 27, and wherein the support elements 12, 12*a* or support ribs 12, 12*a* each comprise elastic elements 14 to bias the respective support element 12, 12*a* or support rib 12, 12*a* towards the protruding configuration C1.

Figure 4:
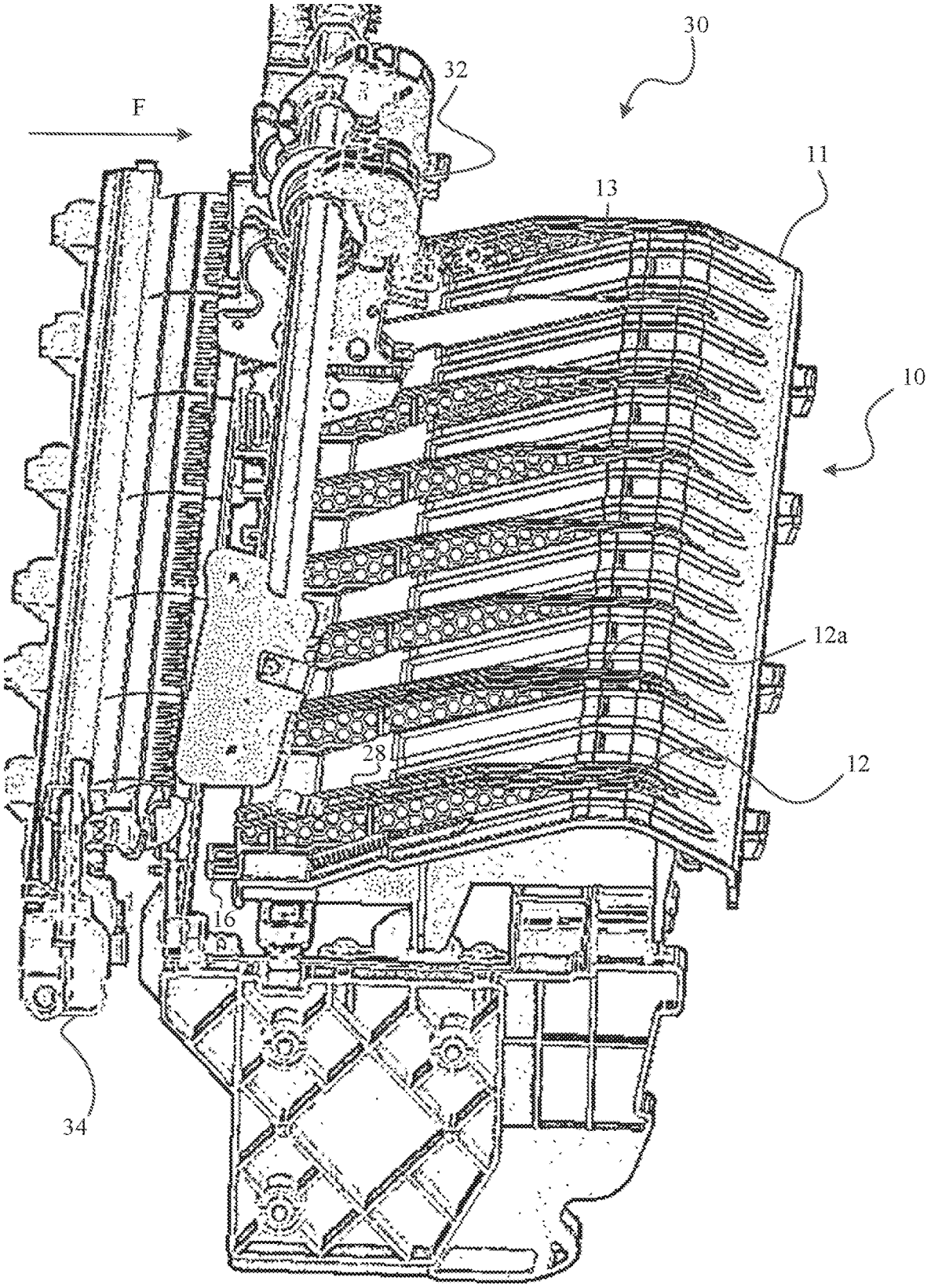
FIG. 4 illustrates a perspective view of a printer according to an example.

FIG. 4 illustrates a cutting stage of a printer 30 comprising a printable medium support 10 with support elements 12, 12*a* similar to the support elements 12, 12*a* illustrated in FIG. 3. The cutting stage comprises a vertical cutter 32 to adjust a width of a plot of the printable medium P and a horizontal cutter 34 to adjust a length of a plot of the printable medium P.

The printable medium P is fed along the feeding direction F past the horizontal cutter 34 and into the vertical cutter 32 where the printable medium P may be cut along the feeding direction F. After passing the vertical cutter 32, the printable medium P can be supported by the support elements 12, 12*a* of the printable medium support 10.

The printable medium P may then be cut by the horizontal cutter 34 to define the length of the plot of the printable medium P.

The support elements 12, 12*a* of the printable medium support 10 may provide continuous guidance for the printable medium P through the stage of the printer 30. However, the support elements 12, 12*a* may also obstruct the movement of the vertical cutter 32, which may be movable in a direction perpendicular to the feeding direction F, i.e. along the support structure 11, to adjust the width of the plot.

To move past the support elements 12, 12*a* and thereby adjust the width of the plot of the printable medium P, the vertical cutter 32 may engage the protruding portion 16 of the support element 12 and thereby move the support element 12 into the retracted configuration C2. In the retracted configuration C2, the support element 12 may be retracted into the printable medium support 10 and may therefore not obstruct the movement of the vertical cutter 32.

Figure 5:
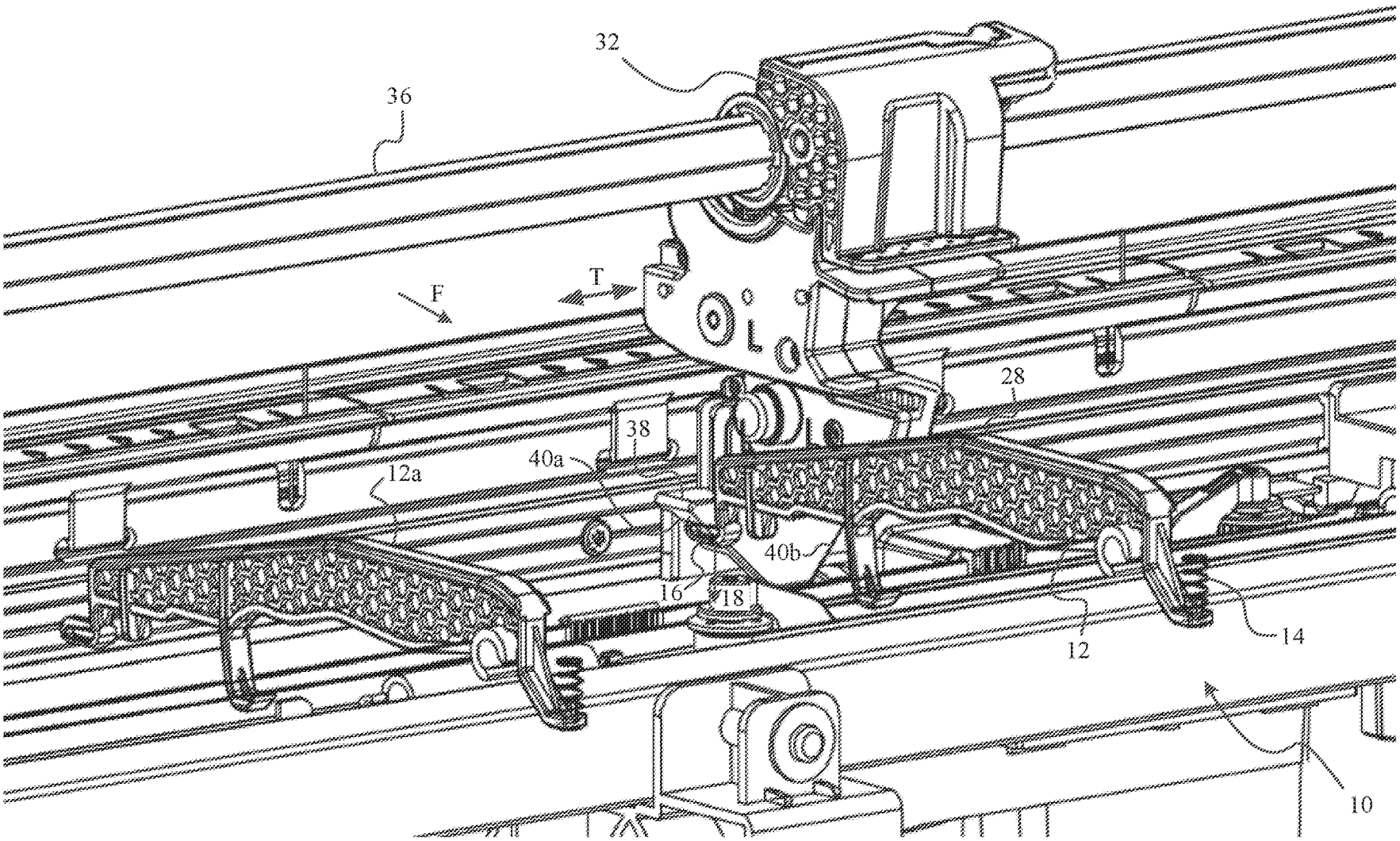
FIG. 5 illustrates a perspective view of a movable printer element engaging a support element of a printable medium support according to an example.

FIG. 5 shows an example of a cutting stage of a printer 30 similar to the printer 30 of FIG. 4 comprising a movable cutter 32 to cut a printable medium P. The cutting stage of the printer 30 further comprises a printable medium support 10 comprising a support element 12 to support the printable medium P while being cut by the cutter 32, the support element 12 being movable between a protruding configuration C1 to support the printable medium P, and a retracted configuration C2 in which the support element 12 is at least partially retracted in a first direction 18. The printable medium support 10 further comprises an actuating element 14 to move the support element 12 between the protruding configuration C1 and the retracted configuration C2, such as an elastic element 14 to bias the support element 12 towards the protruding configuration C1. The cutter 32 comprises an engaging element 38 to engage the support element 12 and to move the support element 12 from the protruding configuration C1 towards the retracted configuration C2.

For illustrative purposes, the cutter in FIG. 5 is depicted as a vertical cutter 32 being movable along a shaft 36 in a displacement direction T to adjust the width of a plot of a printable medium P which is fed along the feeding direction F.

The vertical cutter 32 may comprise an engaging portion 38 to engage or actuate the actuating element 14 of the support element 12 or to engage a protruding portion 16 of the support element 12. As depicted in FIG. 5, the engaging portion 38 may comprise an inclined plane 40*a* to engage the protruding portion 16. The inclined plane 40*a* may be tilted with respect to the first direction 18, such as to move the protruding portion 16 in the first direction 18 towards the retracted configuration C2 when the inclined plane 40*a* engages the protruding portion 16 of the support element 12 and when the vertical cutter 32 is moved along the displacement direction T.

When the engaging portion 38 does not engage the protruding portion 16, the elastic element 14 may provide a restoring force to move the support element 12 towards the protruding configuration C1 to support the printable medium P.

When the vertical cutter 32 is moved past the support element 12, the vertical cutter 32 may engage the protruding portion 16 and the support element 12 may then be automatically moved or forced into the retracted configuration C2. Thus, the support element 12 may not obstruct the movement of the vertical cutter 32 when the width of the plot is adjusted. However, the support element 12 may provide continuous guidance for the printable medium P when the engaging portion 38 does not engage the protruding portion 16 of the support element 12.

As shown in FIG. 5, the engaging portion 38 may comprise a first sloped surface 40*a* and a second sloped surface 40*b* on opposite sides of the engaging element 38 to engage the protruding portion 16 of the support element 12 and move the support element 12 into the retracted configuration C2 independently of the displacement direction T.

In some examples, when the engaging portion 38 engages the protruding portion 16 of the support element 12, the protruding portion 16 slides along the first and/or second sloped surface 40*a*, 40*b*, while the cutter 32 is moved along the displacement direction T, wherein the sliding motion of the protruding portion 16 moves the support element 12 into the retracted configuration C2.

In some examples, the tilt angle between the normal of the first and/or second sloped surface 40*a*, 40*b* and the displacement direction T is between 20° and 70°, or between 30° and 60°, or between 40° and 50°, such as 45°.

Figure 6:
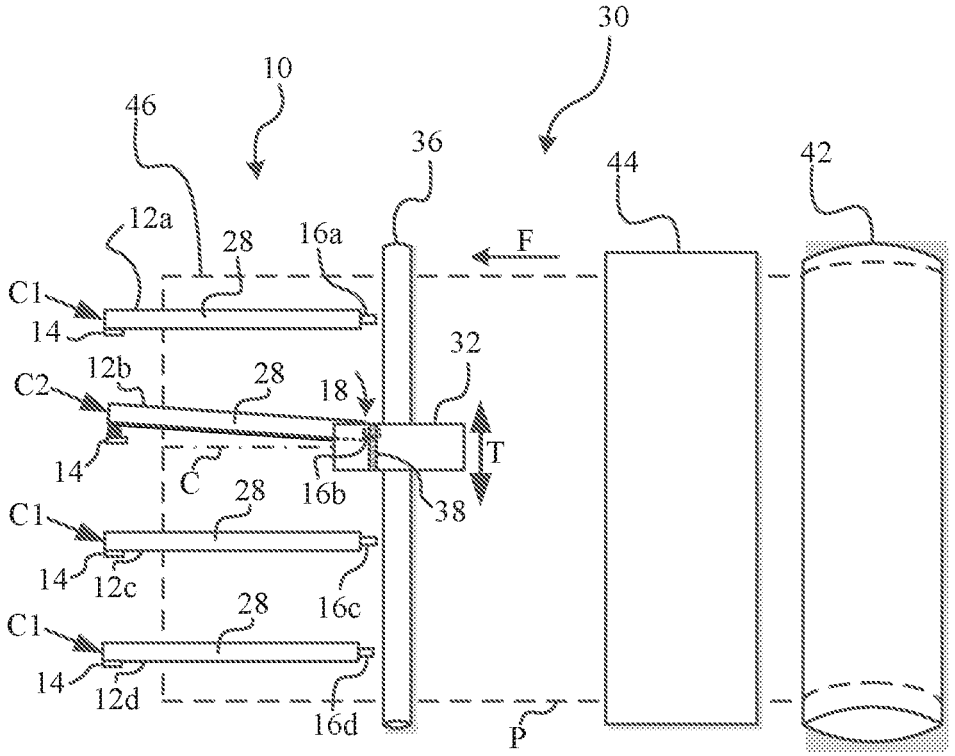
FIG. 6 illustrates a schematic top view of a printer according to an example.

FIG. 6 schematically shows a printer 30 compatible with the cutting stage depicted in FIG. 5. The printer 30 comprises a printable medium source 42 to provide a printable medium P, which is fed along a feeding direction F through a printing zone 44 to apply a printing fluid to the printable medium P.

A cutter 32 can be moved along a shaft 36 in a displacement direction T and cuts the printable medium P to provide the cut C and thereby obtain a plot 46 of the printable medium P. Downstream of the cutter 32 in the feeding direction F, the printable medium P is supported by upper surfaces 28 of support elements 12*a*, 12*b*, 12*c*, 12*d* of a printable medium support 10. The support elements 12*a*, 12*b*, 12*c*, 12*d* may each comprise a protruding portion 16*a*, 16*b*, 16*c*, 16*d*, which is engageable by an engaging element 38 of the cutter 32, and elastic elements 14 to bias the support elements 12*a*, 12*b*, 12*c*, 12*d* towards the protruding configuration C1.

In an example, such as the one depicted in FIG. 6, the cutter 32 is close to the support element 12*b* and the engaging element 38 of the cutter 32 engages the protruding portion 16*b* of the support element 12*b* to move the support element 12*b* into the retracted configuration C2. Hence, the cutter may move along or past the support element 12*b* largely unobstructed.

In some examples and as shown in FIG. 6, the cutter 32 is a vertical cutter 32 to cut the printable medium P along the feeding direction F of the printable medium P, wherein the vertical cutter 32 adjusts the width of the plot 46 of the printable medium P by cutting the printable medium P. In other examples, the cutter may move or cut in another direction.

Figure 7:
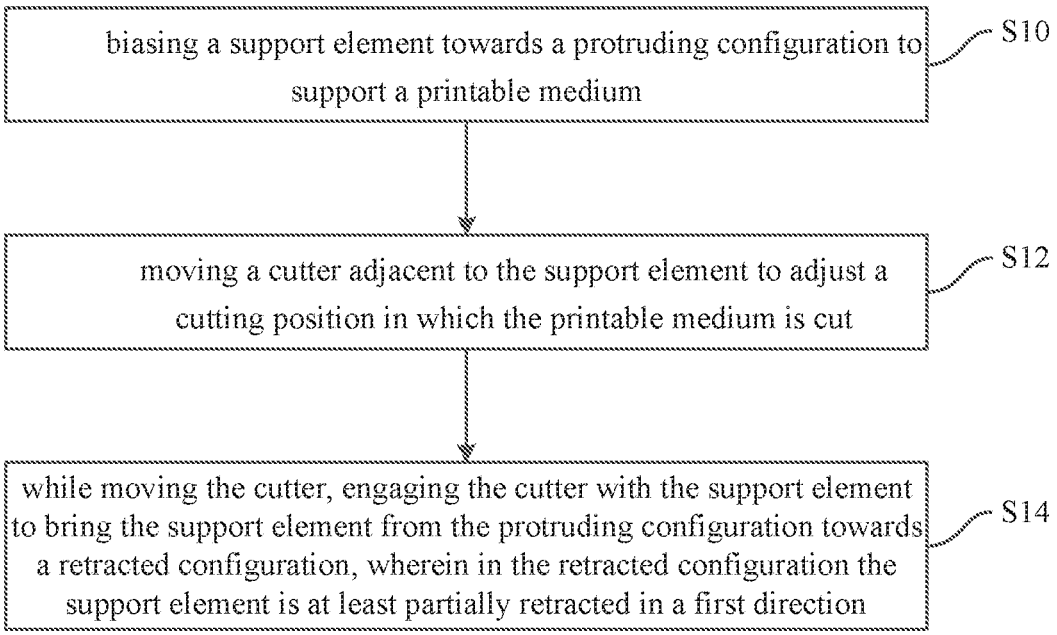
FIG. 7 illustrates a flow chart of a method to configure a cutting stage of a printer according to an example.

FIG. 7 shows a flow diagram to illustrate a method for configuring a cutting stage of a printer 30. The method comprises biasing a support element 12 towards a protruding configuration C1 to support a printable medium (S10), moving a cutter 32, 34 adjacent to the support element 12 to adjust a cutting position in which the printable medium P is cut (S12), and while moving the cutter 32, 34, engaging the cutter 32, 34 with the support element 12 to bring the support element 12 from the protruding configuration C1 towards a retracted configuration C2, wherein in the retracted configuration C2 the support element 12 is at least partially retracted in a first direction 18 (S14).

The support element 12 may be a support element 12 according to any of the examples of a printable medium support 10 described above. Biasing the support element 12 may comprise providing an actuating element 14, such as an elastic element 14 as part of the support element 12 or connected to the support element 12 to keep the support element 12 in the protruding configuration C1, when the support element 12 supports the printable medium P.

In the protruding configuration C1, the support element 12 may provide guidance for a feed of printable medium P fed along a feeding direction F through the printer 30. However, the support element 12 may obstruct the movement of the cutter 32, 34 when the support element 12 is in the protruding configuration C1. In the retracted configuration C2, the support element 12 is retracted and may therefore allow the cutter 32, 34 to move past the support element 12.

In some examples, engaging the cutter 32, 34 with the support element 12 comprises engaging the cutter 32, 34 with a protruding portion 16 of the support element 12, the protruding portion 16 protruding from the support element 12 in a second direction 20.

To engage the support element with the cutter 32, 34, the cutter 32, 34 may comprise an engaging element 38 which may induce a force component onto the support element 12 in the first direction 18 when the engaging portion 38 of the cutter 32, 34 engages the protruding portion 16 during the movement of the cutter 32, 34. Hence, the support element 12 may be moved into the retracted configuration C2 when the cutter 32, 34 passes the support element 12. When the cutter 32, 34 has moved past the support element 12, the support element 12 may be automatically moved towards the protruding configuration C1 by the restoring force of the elastic element 14.

In some examples, the cutter 32, 34 is a vertical cutter 32 to cut the printable medium P along a feeding direction F of the printable medium P, and moving the vertical cutter 32 adjusts the width of a plot 46 of the printable medium P which is cut by the vertical cutter 32.

Hence, the support element 12 may guide the printable medium P along the feeding direction F in the printer 30 while allowing the vertical cutter 32 to adjust the width of a plot 46 of the printable medium P by moving past the support element 12.

In the examples described herein, the protruding portion is engaged by an engaging element of a cutter. However, the printable medium support as described herein can be engaged by any movable element of a printer and should not be construed to be limited to cutting elements.

The invention claimed is:

1. A printable medium support for a printer comprising:

a support element to support a printable medium, the support element being movable between:

a protruding configuration to support the printable medium, and a retracted configuration in which the support element is at least partially retracted in a first direction; and the printable medium support comprising an actuating element to move the support element between the protruding configuration and the retracted configuration, wherein the support element comprises a protruding portion being engageable to move the support element into the retracted configuration, the protruding portion protruding from the support element in a spaced position away from the printable medium when in the protruding configuration.

2. The printable medium support of claim 1, wherein the actuating element comprises an elastic element to bias the support element towards the protruding configuration; and wherein the protruding portion protrudes from the support element in a second direction.

3. The printable medium support of claim 2, wherein the elastic element keeps the support element in the protruding configuration against a weight of the printable medium, when the support element supports the printable medium.

4. The printable medium support of claim 2, wherein the second direction is different from the first direction, or wherein the first direction and the second direction form an angle greater than 30°, or greater than 60°, or between 70° and 110°.

5. The printable medium support of claim 2, wherein the protruding portion comprises a frustum or a cylinder, wherein a normal of the base of the cylinder or the frustum extends in the second direction.

6. The printable medium support of claim 2, wherein the printable medium support is connectable to an adjacent element of the printer, the adjacent element of the printer comprising a movable portion to engage the protruding portion and move the support element into the retracted configuration.

7. The printable medium support of claim 1, wherein the support element or a portion of the support element is rotatable about an axis of rotation, and wherein the support element changes between the protruding configuration and the retracted configuration, when the support element is rotated about the axis of rotation.

8. The printable medium support of claim 1, wherein in the retracted configuration the support element is at least partially retracted into the printable medium support, and/or wherein the support element comprises a support rib, the longest side of the support rib extending at least partially in a feeding direction of the printable medium and the support rib protruding from the printable medium support in the first direction, when the support rib is in the protruding configuration.

9. A printer comprising:

a cutter to cut a printable medium and being movable; and a printable medium support comprising:

a support element to support the printable medium while being cut by the cutter, the support element being movable between:

a protruding configuration to support the printable medium, and a retracted configuration in which the support element is at least partially retracted in a first direction; and an actuating element to move the support element between the protruding configuration and the retracted configuration;

wherein the cutter comprises an engaging element to engage the support element via direct frictional contact and to move the support element from the protruding configuration towards the retracted configuration while the printable medium is being cut by the cutter.

10. The printer of claim 9, wherein the cutter is movable along the support element, and moves the support element from the protruding configuration towards the retracted configuration as the cutter moves along the support element.

11. The printer of claim 9, wherein the engaging element of the cutter comprises an inclined plane to engage a protruding portion of the support element, the inclined plane being tilted with respect to the first direction to move the support element towards the retracted configuration when the inclined plane engages the support element.

12. The printer of claim 9, wherein the engaging element comprises a first sloped surface and a second sloped surface on opposite sides of the engaging element to engage the support element, the first and/or second sloped surfaces being tilted with respect to a displacement direction of the cutter, and/or wherein a tilt angle between the normal of the first and/or second sloped surface and the displacement direction is between 20° and 70°, or between 30° and 60°, or between 40° and 50°.

13. A method for configuring a cutting stage of a printer, the method comprising:

biasing a support element towards a protruding configuration to support a printable medium;

moving a cutter adjacent to the support element to adjust a cutting position in which the printable medium is cut; and while moving the cutter, engaging the cutter with the support element via direct frictional contact to bring the support element from the protruding configuration towards a retracted configuration while the printable medium is being cut by the cutter, wherein in the retracted configuration the support element is at least partially retracted in a first direction.

14. The method of claim 13, wherein the engaging the cutter with the support element comprises engaging the cutter with a protruding portion of the support element, the protruding portion protruding from the support element in a second direction.

15. The method of claim 13, wherein the cutter is a vertical cutter to cut the printable medium along a feeding direction of the printable medium, and moving the vertical cutter adjusts the width of a plot of the printable medium which is cut by the vertical cutter.

* * * * *